US007075251B2

(12) United States Patent
Chen et al.

(10) Patent No.: US 7,075,251 B2
(45) Date of Patent: Jul. 11, 2006

(54) UNIVERSAL PLATFORM FOR PHASE DIMMING DISCHARGE LIGHTING BALLAST AND LAMP

(75) Inventors: Timothy Chen, Aurora, OH (US); James K. Skully, Willoughby, OH (US)

(73) Assignee: General Electric Company, Schenectady, NY (US)

( * ) Notice: Subject to any disclaimer, the term of this patent is extended or adjusted under 35 U.S.C. 154(b) by 283 days.

(21) Appl. No.: 10/729,758

(22) Filed: Dec. 5, 2003

(65) Prior Publication Data

US 2005/0122057 A1 Jun. 9, 2005

(51) Int. Cl.
*H05B 37/00* (2006.01)

(52) U.S. Cl. ..... 315/291; 315/224; 315/307

(58) Field of Classification Search ..... 315/224, 315/225, 291, 219, 307, 308, 209 R, 244, 315/247, 276, 208
See application file for complete search history.

(56) References Cited

U.S. PATENT DOCUMENTS 5,689,442 A 11/1997 Swanson et al. ..... 380/241
5,757,143 A * 5/1998 Hernandez Martucci et al. 315/247
5,914,572 A * 6/1999 Qian et al. ..... 315/307
6,051,938 A * 4/2000 Arts et al. ..... 315/291
6,144,169 A * 11/2000 Janczak ..... 315/224
6,175,195 B1 1/2001 Janczak et al. ..... 315/194
6,339,298 B1 1/2002 Chen ..... 315/226
6,348,767 B1 2/2002 Chen et al. ..... 315/224
6,417,631 B1 7/2002 Chen et al. ..... 315/291
6,674,248 B1 * 1/2004 Newman et al. ..... 315/247
6,750,842 B1 * 6/2004 Yu ..... 345/102
6,809,483 B1 * 10/2004 Alexandrov ..... 315/224
6,822,401 B1 * 11/2004 Borella et al. ..... 315/291
6,833,678 B1 * 12/2004 Mayer et al. ..... 315/247
2002/0140373 A1 * 10/2002 Ribarich et al. ..... 315/224

* cited by examiner

*Primary Examiner*—Wilson Lee
(74) *Attorney, Agent, or Firm*—Pearne & Gordon LLP

(57) ABSTRACT

A ballast, or power supply circuit, for gas discharge lamps of the type using IC control based gate-drive circuitry for controlling a pair of serially connected switches of a d.c.-a.c. inverter. More particularly, the invention relates to a ballast having a resonant feedback circuit drawing continuous input current from a wide range of source voltages to satisfy requirements of phase control dimmers. Even more particularly, the invention relates to a universal platform for phase dimming discharge lighting using the Ballast and a discharge Lamp with a phase dimming circuit.

32 Claims, 3 Drawing Sheets

UNIVERSAL PLATFORM FOR PHASE DIMMING DISCHARGE LIGHTING BALLAST AND LAMP

FIELD OF THE INVENTION

The present invention relates to a ballast, or power supply circuit, for gas discharge lamps of the type using IC control based gate-drive circuitry for controlling a pair of serially connected switches of a d.c.-a.c. inverter. More particularly, the invention relates to a ballast having a resonant feedback circuit drawing continuous input current from a wide range of source voltages to satisfy requirements of phase control dimmers. Even more particularly, the invention relates to a universal platform for phase dimming discharge lighting using the Ballast and a discharge Lamp with a phase dimming circuit.

DESCRIPTION OF THE RELATED ART

Phase-controlled dimmable ballasts have gained a growing popularity in industry due to their capability for use with photo cells, motion detectors and standard wall dimmers.

Dimming of fluorescent lamps with class D converters is accomplished by either regulating the lamp current, or regulating the power of a discharge lamp. For cold cathode fluorescent lamps (CCFLs), the pulse width modulating (PWM) technique is commonly used to expand a dimming range. The technique pulses the CCFLs at full rated lamp current thereby modulating intensity by varying the percentage of time the lamp is operating at full-rated current. Such a system can operate with a closed loop or an open loop system. The technique is simple, low cost, and a fixed frequency operation. However, it is not easily adapted to hot cathode fluorescent lamps.

For proper dimming of hot cathode lamps, the cathode heating needs to be increased, as light intensity is reduced. If inadequate heating exists, cathode sputtering increases as the lamp is dimmed. Also, the lamp arc crest factor should be less than 1.7 for most dimming ranges, in order to maintain the rated lamp life. The higher the crest factor, the shorter will be the life of the lamp. The PWM method does not address these problems, and therefore so far has been limited to CCFL applications.

Class D inverter topology with variable frequency dimming has been widely accepted by the lighting industry for use in the preheat, ignition and dimming of a lamp. The benefits of such a topology include, but are not limited to (i) ease of implementing programmable starting sequences which extend lamp life; (ii) simplification of lamp network design; (iii) low cost to increase lamp cathode heating as the lamp is dimmed; (iv) obtainable low lamp arc crest factor; (v) ease of regulating the lamp power by either regulating the lamp current or the average current feeding the inverter; and (vi) zero voltage switching can be maintained by operating the switching frequency above the resonant frequency of the inverter.

In incandescent lamp dimming systems, dimming is typically controlled by a phase dimmer, also known as a triac dimmer. A common type of phase dimmer blocks a portion of each positive or negative half cycle immediately after the zero crossing of the voltage. The clipped waveform carries both the power and dimming signal to the loads. The dimmer replaces a wall switch which is installed in series with a power line.

It would be desirable to use existing phase dimmer signals for dimming of fluorescent lamps. A system designed to use existing triac phase dimmers must satisfy the requirements of the triac, one of which is a holding current specification. When the triac is in a conducting state, the current through the triac must remain above the specified holding current in order for the triac not to switch off and interrupt current.

It would also be desirable to have such a system use a single-stage design for dimming and interfacing with a phase dimmer, provided at a low cost, with minimal voltage and current stresses on a resonant circuit. Still a further desirable aspect is to have a circuit which would allow programmable starting sequences to extend a lamp life, allow for low lamp arc crest factors and zero voltage switching over wide ranges. Such a system should also include compact size with low component counts and be easily adapted for different line input voltage and powers and provide for adequate protection for abnormal operations.

Further, some solutions that currently exist require the use of high voltage components due to the use of voltage doubler circuits that provide a bus voltage at twice the peak input voltage. This makes it difficult to provide solutions for sale in countries that use relatively high voltage power sources (200V and above) because of the high cost of the required components. It would be desirable to implement a design that supports high voltage power systems (over 200V), and yet does not require the use of high-voltage components, thus reducing costs and also allowing use of the apparatus in a global market.

Even further, some solutions are sensitive to low voltage conditions and fluctuating voltages, which can make the operation suspect at high dimming modes due to a drop in the triac holding currents and/or a shut-down of the apparatus itself due to low current draws at high dimming settings. A solution that supports high dimming modes for an improved dimming range that is insensitive to voltage fluctuations and transients is thus desirable.

SUMMARY OF THE INVENTION

Provided is an electronic ballast having an input rectifier circuit for rectifying an input voltage, a voltage inverter circuit for receiving a rectified input voltage from the input rectifier circuit and for providing voltage/current to a discharge lamp for providing a dimmable light; a controller for controlling the operation of the voltage inverter circuit; and a keep-alive feedback circuit for feeding back energy from the discharge lamp to the voltage inverter circuit to allow a high dimming operation.

Also provided is an electronic ballast having an input rectifier circuit for rectifying an input voltage; a voltage inverter circuit for receiving a rectified input voltage from the input rectifier circuit and for providing voltage/current to a discharge lamp for providing a dimmable light; a controller for controlling the operation of the voltage inverter circuit; and a constant voltage supply circuit for supplying a substantially constant voltage to the controller. The constant voltage supply circuit provides the substantially constant voltage both at low input currents and at high input currents.

Still further provided is an electronic ballast comprising: an input rectifier circuit for rectifying an input voltage from a dimming circuit; a voltage inverter circuit having solid-state switches for receiving a rectified input voltage from the input rectifier circuit and for providing voltage/currents to a discharge lamp for providing a dimmable light; a controller for controlling the operation of the voltage inverter circuit; a keep-alive feedback circuit for feeding back energy from the discharge lamp to the voltage inverter circuit to allow a high dimming operation; and a constant voltage supply circuit for supplying a substantially constant voltage to the controller.

The constant voltage supply circuit uses a voltage of the discharge lamp to generate the substantially constant voltage during a high dimming operation of the dimming circuit. Further, the constant voltage supply circuit uses the voltage/current of the inverter circuit to generate the substantially constant voltage during a low dimming operation of the dimming circuit.

DETAILED DESCRIPTION OF THE PREFERRED EMBODIMENTS OF THE INVENTION

The new Universal Plafform For Phase Dimming Discharge Lighting Ballast is a new platform replacing an older, "Doubler Circuit Topology", for a global market in high-end performance dimmable CFL at a reduced cost. This new platform can be used with florescent or other discharge lighting to save energy in comparison to incandescent lamps, and yet deliver soft uniform lighting for application in homes and office buildings.

The platform utilizes a single-stage based topology using only one energy storage element. It features relatively low bus voltage that enables the use of low cost high efficiency switching devices. It has a built in constant power supply to provide d.c. bias to an IC controller in spite of large voltage variations on an input bus utilizing the triac control.

Figure 1:
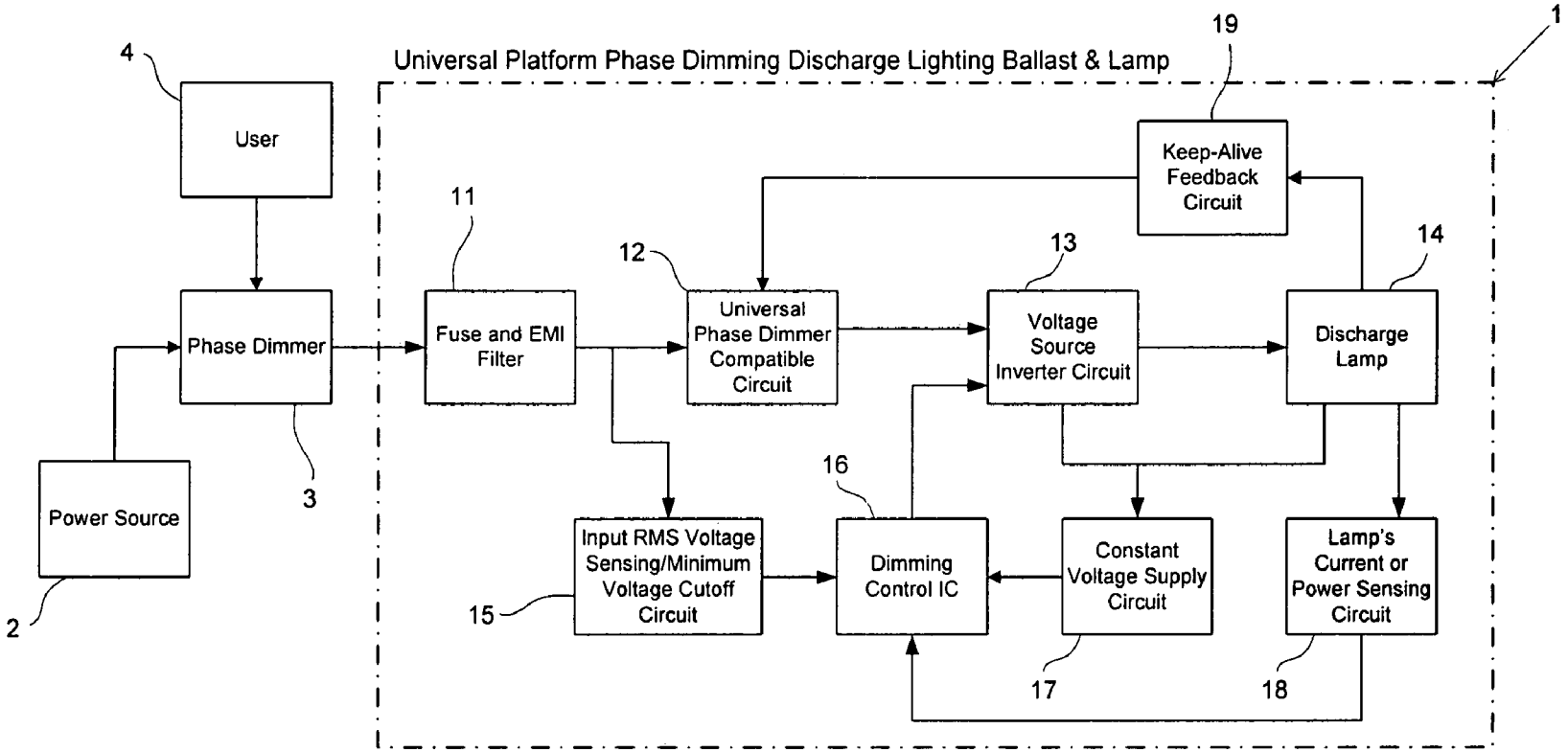
FIG. 1 is a block diagram showing the major functional circuits of the apparatus.

The FIG. 1 is the block diagram showing the major functional circuits of the Universal Platform For Phase Dimming Discharge Lighting Ballast and Lamp along with major external connections and the primary interactions between the circuits. An apparatus 1 connects to an external Phase Dimmer 3 which is typically adjusted by a User 4. The Phase Dimmer 3 is typically connected to an external power source 2. A wide range of consumer and/or industrial power systems are acceptable for the external Power Source 2, including 110/120V a.c. systems and 210/220/240V a.c. systems, among others. Thus the apparatus 1 can be designed for use globally.

The apparatus 1 is comprised of a Fuse and EMI Filter 11, which connects to the external phase dimmer circuit. The Fuse and EMI Filter 11 provides filtered power to a Universal Phase Dimmer Compatible Circuit 12, and an Input RMS Voltage Sensing/Minimum Voltage Cutoff Circuit 15 monitors the input voltage. The Universal Phase Dimmer Compatible Circuit 12 rectifier rectifies the incoming voltage and thus provides a DC power source for the other circuits in the apparatus 1, while the Input RMS Voltage Sensing/Minimum Voltage Cutoff Circuit 15 monitors the input voltage, and hence the dim setting of the Phase Dimmer 3, and provides the result to a Dimming Control IC 16 controller, which provides the primary control for the apparatus 1.

The Universal Phase Dimmer Compatible Circuit 12 rectifier is compatible with the various phase dimmers to be used by the user, and the platform can be designed to make the apparatus useable in various nations with differing voltage supplies at a reasonable cost. Further, the rectifier 12 provides a DC current and voltage to a Voltage Source Inverter Circuit 13, which is controlled by the Dimming Control IC 16.

The Voltage Source Inverter Circuit 13 converts the DC voltage from the Universal Phase Dimmer Compatible Circuit 12 into high-frequency voltage/current pulses such as an alternating current (a.c.) provided to a Discharge Lamp 14. The inverter circuit 13 output pulses are sufficient to trigger the lamp 14 to generate light and regulating the lamp's current at the desired dim level.

A Constant Voltage Supply Circuit 17 provides a constant voltage supply to the Dimming Control IC 16 controller. Further, the Constant Voltage Supply Circuit 17 is adapted to ensure that the voltage supply to the controller 16 does not fall below the minimum required to keep the controller 16 active while the user is operating the Phase Dimmer 3 in a high-dimming mode. Without this adaptation, the controller 16 would shut down the apparatus 1 at high dimming modes, when the input voltage from the Phase Dimmer 3 is too low for the inverter circuit 13 to provide a sufficient voltage to power the controller 16 and keep it operating. Accordingly, the processor 16 would shut down the apparatus at high dimming operations without the circuit 17. With the adaptation, the apparatus 1 is able to operate at wider dimming ranges. This is not a problem when the phase dimmer is operated at low dimming modes, because under that condition, the additional current from 17 is high enough such that the dimming control IC 16 to keep it properly operating. Consequently, the Constant Voltage Supply Circuit 17 widens the dimming range that can be supported by the apparatus.

A Lamp's Current or Power Sensing Circuit 18 senses the current, voltage, or both (and hence power) of the Discharge Lamp 14 and provides that information to the Dimming Control IC 16 controller to support the monitoring and control operations of the controller 16. Further, the Input RMS Voltage Sensing/Minimum Voltage Cuttoff Circuit provides information about the input voltage, and hence dim setting of the Phase Dimmer 3, to the controller 16. These inputs aid the controller 16 in properly controlling the inverter circuit 13 at the proper frequency and voltage for the desired dimming level, as set by the Phase Dimmer 3. Hence, the controller can set the inverter circuit 13 to the proper dimming level based on the Phase Dimmer 3 setting. Further, the controller 16 can have programmable starting sequences to extend a lamp life and disable (Cuttoff) the inverter circuit if the sensed RMS is minimum setting level. Note that not all control connections are necessarily shown in FIG. 1.

Finally, a Keep-Alive Feedback Circuit 19 is provided to ensure that the apparatus 1 draws a sufficient current from the Phase Dimmer 3 to above "keep-alive" the current supplied by the Phase Dimmer 3. Typical phase dimmer circuits utilize one or more triac components that require a minimum holding current (i.e., keep-alive current) to stay in a conducting mode, and hence provide an output current. Without the Keep-Alive Feedback Circuit 19, at dimming (i.e., chopped voltage wavefrom) current) modes, the apparatus 1 might draw an insufficient current, allowing the triac to cut-off, and shut the apparatus 1 down at dimming, thereby dimmer will re-trigger and cause flicking observed by user. By adding the feedback circuit 19, the apparatus 1 is able to operate and stable over wider dimming ranges than it could without it.

Figure 2:
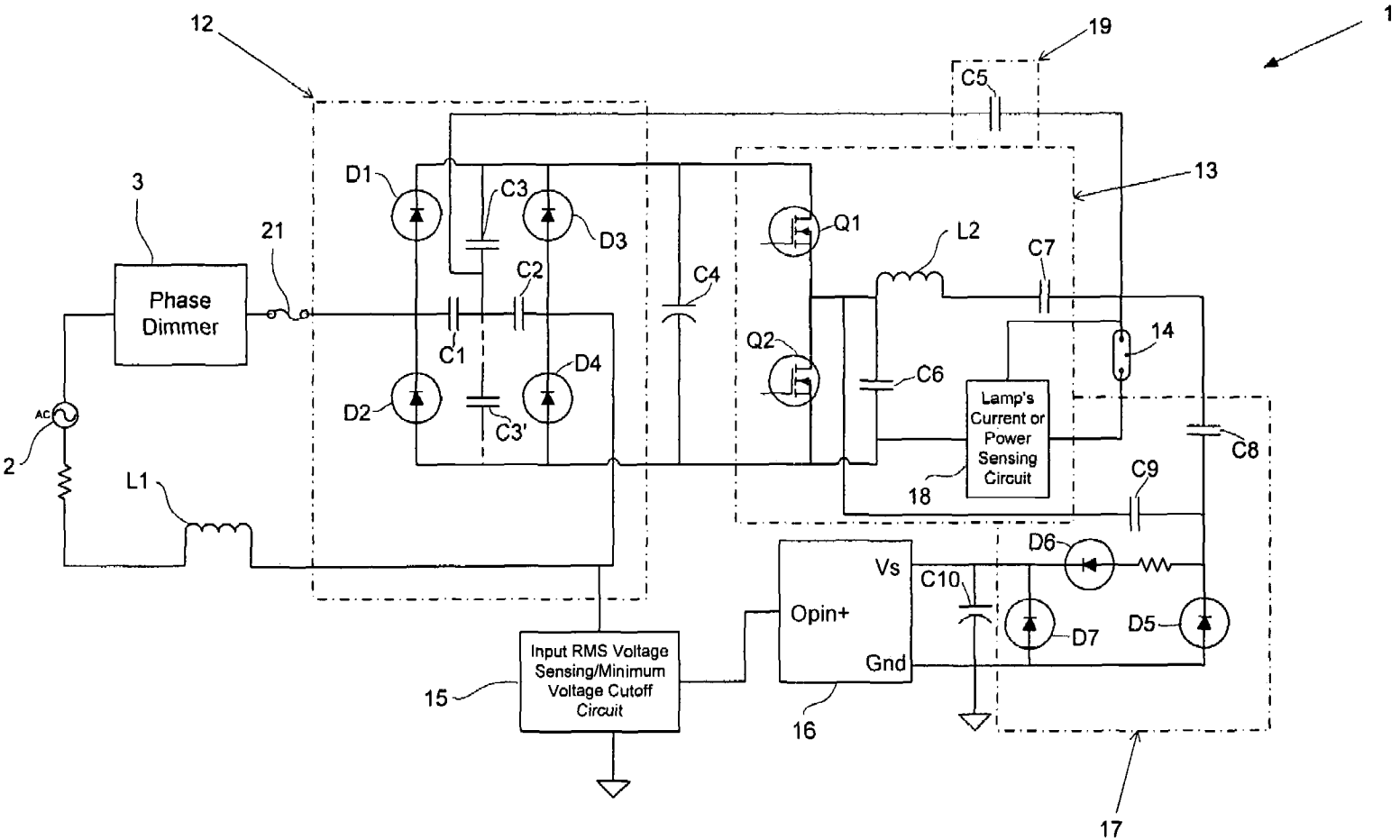
FIG. 2 is a circuit diagram showing the major circuit components of the apparatus.

FIG. 2 shows many of the apparatus 1 circuits in more detail with the primary electrical connections shown, although the control connections are typically not shown. In FIG. 2, a Phase Dimmer 3 is inserted in a hot side of the Power Source 2 and the output of the Power Source 2 is connected to the EMI filter which comprises inductor L1, and capacitors C1 & C2. The capacitors C1 & C2 are also used in the Universal Phase Dimmer Compatible Circuit 12. Differing from a conventional full rectify bride circuit, the bridge diodes D1, D2, D3 & D4, in this case, are normally operating in high frequency mode instead of the line frequency over large portion of the input line cycle.

The Universal Phase Dimmer Compatible Circuit 12 is designed such that, at any given time, at least one diode is conducting. This occurs because of capacitor C5, which operates as a keep-alive feedback circuit to provide feedback energy to keep at least one diode conducting at all times. The action of the bridge diodes are softly turned on and off by a resonant feedback current from C5. Therefore, the compatible circuit 12 draws a substantially continuous input current from the Phase Dimmer 3. And the circuit 12 is also designed to maintain the current level at each half line cycle to be above minimum holding current of the triac in the Phase Dimmer 3, if any. Therefore, it eliminates the undesirable flickering of Discharge Lamp 14 due to the triac switching off if the stay-alive current drops below the required minimum and then re-triggering when the current rises. Accordingly, the addition of C5 increases the range of desirable dimming operation that the apparatus 1 can support, bringing the apparatus more in line with incandescent lighting.

Capacitor C3 is provided as part of the Universal Phase Dimmer Compatible Circuit 12 to improve the crest factor of the lamp by reducing the variation of the effective resonant capacitor. The two capacitors, C1 & C2, are used to balance interfacing circuit operation. However, the circuit could operate with just a single capacitor. The inverter circuit basically utilizes a typical series resonant parallel load voltage fed topology. Unlike a conventional one, however, the capacitor C5, is connected back to the center of the C1 and C2, as shown, for the purposes described above and below.

As an alternative, capacitor C3' can be added to the circuit as shown, in place of C3. The operation is as described above and below for capacitor C3. Only one of C3 and C3' are typically necessary.

Figure 3:
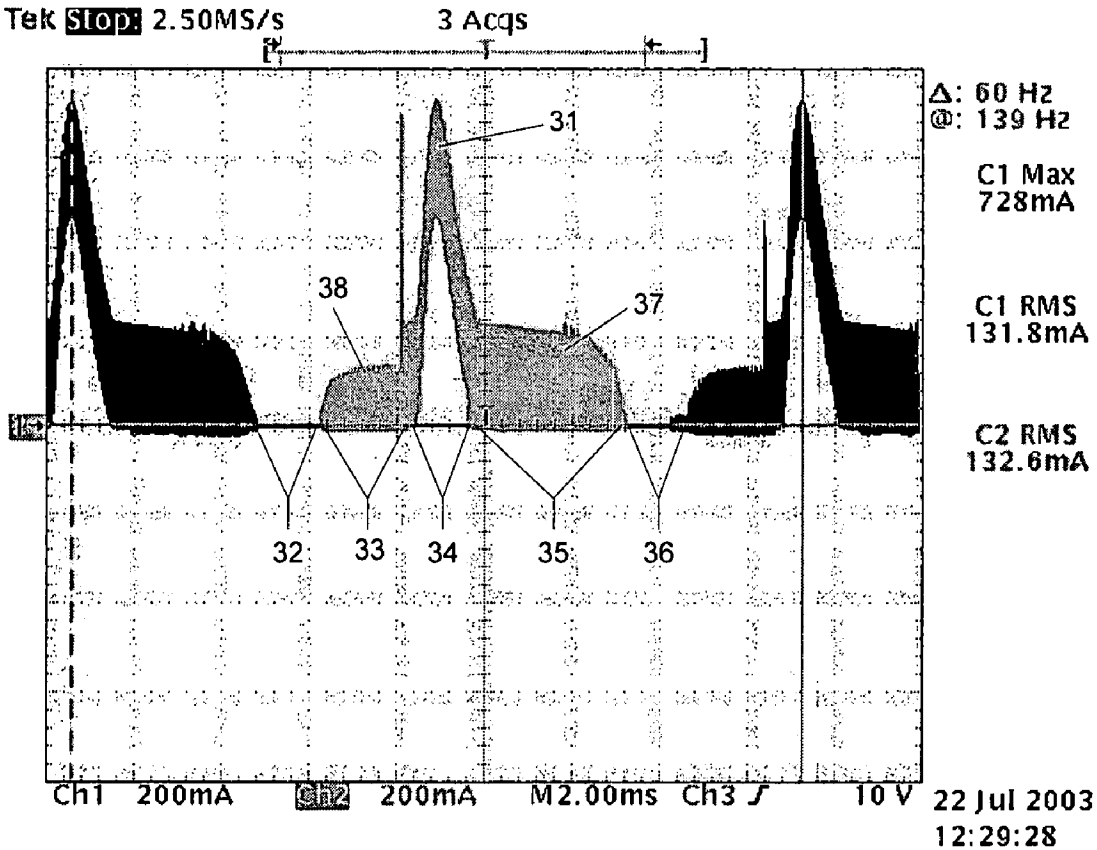
FIG. 3 is a plot of a current of the apparatus over time.

When the inverter circuit starts to operate, the resonant current via the capacitor C5 is fed back to charge and discharge the capacitor C3, in a high frequency manner, thus feeding back energy to the Universal Phase Dimmer Compatible Circuit 12. As FIG. 3 shows, when the input bridge is in a peak charge portion 34 of the D1 current waveform, the input from the a.c. power source is higher than the bus voltage across capacitor C4. Therefore, the a.c. source is directly charging up capacitor C4 through the source voltage. During the holding current portion 35, 33, the a.c. input source has dropped below the charge value on capacitor C4. At this point, the current from capacitor C5 is providing the major portion of the input current. The amount of current supplied by capacitor C5 is dependent upon the size of the capacitor in relationship to the other components of the circuit. Thus, the currents 31, 37, and 38 are kept above the triac cut-off level, and diodes D1, D2, D3 and D4 in a high-frequency switching mode at 37, 38, and at a lower frequency switching mode at 31. The EMI filter ensures that the high frequency component of the feed back current 38, 37, 31 isn't coupling back to the dimmer 3 or to the input power source 2. Further, the periods 32 and 36, when the input current drops low, are too short to re-trigger the triac. Accordingly, the triac of the dimmer 3 stays conducting at dimming modes without flickering.

The Voltage Source Inverter Circuit 13 generates a high-frequency current source to power the Discharge Lamp 14 to induce the lamp to discharge and hence generate light at a sufficiently high frequency to not generate visible flickering for most users. The inverter circuit 13 is comprised of solid-state switches Q1 and Q2 (such as FETs, for example) which are controlled by the controller 16. Inductor L2 and capacitors C6 and C7 form a resonant circuit and work with the switches to convert the d.c. voltage provided by the rectifier 12 to generate the alternating voltage provided to the Discharge Lamp 14.

The controller 16 inputs voltage and/or current information from both the Input RMS Voltage Sensing/Minimum Voltage Cutoff Circuit 15 and the Lamp's Current or Power Sensing Circuit 18 to monitor the status of the apparatus 1 and the dimming setting of the Phase Dimmer 3 to set the inverter circuit 13 to provide the desired dimming levels. The operation and design of the RMS Voltage Sensing/Minimum Voltage Cutoff Circuit 15 and the Lamp's Current or Power Sensing Circuit 18 are derived from various solutions known in the art.

When the Phase Dimmer 3 triac cuts-in to dim the light level, the apparatus bus voltage would vary with output of the peak of voltage of the triac, and the dc bias that powers the Dimming Control IC 16 could drop below a minimum off setting of the controller 16, thus shutting down the controller 16. If only the one supply current via capacitor, C8, is used in the design, the controller 16 could turn off at the highest dimming settings, and could repeat the starting/off sequence.

The circuit shown in FIG. 2 has been adapted such that the power provided to the IC comes from a Constant Voltage Supply Circuit 17, which is comprised of an integrated high frequency source consisting of capacitors C8, C9, and an ac-to-dc converting circuit including diodes D5, D6, D7 and capacitor C9. Capacitor C9 supplies a portion of the current that is directly related to the bus voltage and thus is proportional to the peak input voltage from the source and operating frequency. In contrast, the current from C8 is related to the voltage of the Discharge Lamp 14, which is also frequency dependent. Thus, C8 provides power at low source peak voltage levels. These two current sources are thus complementary to each other, and therefore, when tied together as shown, they provide a substantially constant voltage to the controller 16 as the lamp 14 is dimmed. Thus, the controller 16 power source 17 is substantially insensitive to the input voltage to the apparatus 1, and consequently, the controller 16 can operate over a wider range of dimming operation, and thus the apparatus 1 provides wide dimming range support.

Accordingly, the apparatus 1 will dim the light output of the discharge lamp 14 based on the dimming setting of the Phase Dimmer 3 for a wider range of dim settings at a wide variety of input voltages.

The invention has been described herein above using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. An electronic ballast comprising:

a phase dimmer compatible circuit including an input rectifier circuit for rectifying an input voltage;

a voltage inverter circuit for receiving a rectified input voltage from said phase dimmer compatible circuit, and for providing a voltage and/or current to a discharge lamp for providing a dimmable light; and a keep-alive feedback circuit for feeding back energy from said discharge lamp to said phase dimmer compatible circuit to support a high dimming operation.

2. The ballast of claim 1, wherein said keep-alive feedback circuit utilizes a capacitor for said feeding back energy.

3. The ballast of claim 1, wherein said input rectifier comprises a plurality of diodes, and further wherein said keep-alive feedback circuit comprises a capacitor connected to both said phase dimmer compatible circuit and the discharge lamp for ensuring that at least one of said plurality of diodes is always conducting.

4. The ballast of claim 1 further comprising:

a controller; and a constant voltage supply circuit connected to said phase dimmer compatible circuit and for supplying a substantially constant voltage to said controller, wherein said constant voltage supply circuit uses a voltage of one or both of the discharge lamp and said inverter circuit to provide a substantially constant voltage to said controller when the input current is low due to the high dimming operation.

5. An electronic ballast comprising:

a phase dimmer compatible circuit including an input rectifier circuit for rectifying an input voltage;

a voltage inverter circuit for receiving a rectified input voltage from said phase dimmer compatible circuit, and for providing a voltage and/or current to a discharge lamp for providing a dimmable light; and a keep-alive feedback circuit for feeding back energy from the discharge lamp to said phase dimmer compatible circuit to support a dimming operation, wherein said input rectifier circuit includes: a plurality of diodes operating at a frequency above the frequency of the input voltage, wherein at any given time at least one diode is in a conducting mode due to said keep-alive feedback circuit.

6. The ballast of claim 5, wherein said rectifier circuit further includes a capacitor for reducing a crest factor of the discharge lamp.

7. A dimmable discharge lighting apparatus comprising:

the electronic ballast of claim 1; and said discharge lamp, wherein said apparatus is for providing a dimmable light when connected to a dimming circuit for providing the input voltage.

8. An electronic ballast comprising:

a phase dimmer compatible circuit including an input rectifier circuit for rectifying an input voltage;

a voltage inverter circuit for receiving a rectified input voltage from said input rectifier circuit, and for providing a voltage and/or current to a discharge lamp for providing a dimmable light;

a controller for controlling the operation of the voltage inverter circuit; and a constant voltage supply circuit for supplying a substantially constant voltage to said controller, wherein said constant voltage supply circuit provides said substantially constant voltage both at low input currents and at high input currents, and wherein said constant voltage supply circuit provides a substantially constant voltage related to one or both of a voltage of said inverter circuit and a voltage of the discharge lamp.

9. The ballast of claim 8, wherein said constant voltage supply circuit uses a voltage of the discharge lamp to generate said substantially constant voltage during the low input currents, and further wherein said constant voltage supply circuit uses said voltage pulses of said inverter circuit to generate said substantially constant voltage during the high input currents.

10. The ballast of claim 8, wherein said input voltage is from a dimming circuit, and wherein said constant voltage supply circuit includes:

a first capacitor connected to said inverter circuit for generating a first current based on the voltage of said inverter circuit during a low dimming operation of the dimming circuit; and a second capacitor connected to the discharge lamp for generating a second current based on the voltage of the discharge lamp during a high dimming operation of the dimming circuit, wherein said constant voltage supply circuit sums said first current and said second current to generate said substantially constant voltage.

11. The ballast of claim 10, wherein said constant voltage supply circuit further includes a plurality of diodes for rectifying said first current and said second current.

12. The ballast of claim 8 further comprising a keep-alive feedback circuit for feeding back energy from said discharge lamp to said voltage inverter circuit to allow a high dimming operation of said apparatus.

13. A dimmable discharge lighting apparatus comprising:

the electronic ballast of claim 8; and said discharge lamp, wherein said apparatus is for providing said dimmable light when connected to a dimming circuit for providing the input voltage.

14. An electronic ballast comprising:

a phase dimmer compatible circuit including an input rectifier circuit for rectifying an input voltage from a dimming circuit;

a voltage inverter circuit having solid-state switches for receiving a rectified input voltage from said input rectifier circuit, and for providing a voltage and/or current to a discharge lamp for providing a dimmable light;

a controller for controlling the operation of the voltage inverter circuit;

a keep-alive feedback circuit for feeding back energy from said discharge lamp to said phase dimmer compatible circuit to allow a high dimming operation; and a constant voltage supply circuit for supplying a substantially constant voltage to said controller, wherein said constant voltage supply circuit uses a voltage of the discharge lamp to generate said substantially constant voltage during a high dimming operation of the dimming circuit, and further wherein said constant voltage supply circuit uses said voltage/current of said inverter circuit to generate said substantially constant voltage during a low dimming operation of the dimming circuit.

15. The ballast of claim 14, wherein said input rectifier includes:

a plurality of rectifier diodes operating at a frequency above the frequency of the input voltage, wherein at any given time at least one diode is in a conducting mode due to said keep-alive feedback circuit; and a capacitor for reducing a crest factor of the discharge lamp.

16. The ballast of claim 15, wherein said constant voltage supply circuit includes:

a first capacitor connected to said inverter circuit for generating a first current based on a voltage of said inverter circuit; and a second capacitor connected to the discharge lamp for generating a second current based on a voltage of said discharge lamp, wherein said constant voltage supply circuit sums the first current and the second current to generate said substantially constant voltage.

17. The ballast of claim 16, wherein said keep-alive feedback circuit utilizes a capacitor for said feeding back energy.

18. A dimmable discharge lighting apparatus comprising:

the electronic ballast of claim 17; and said discharge lamp, wherein said apparatus is for providing a dimmable light when connected to the dimming circuit having a phase dimmer.

19. A dimmable discharge lighting apparatus comprising:

the electronic ballast of claim 14; and said discharge lamp, wherein said apparatus is for providing a dimmable light when connected to the dimming circuit having a phase dimmer.

20. The ballast of claim 14, wherein said constant voltage supply circuit includes:

a first capacitor for generating a first current based on a voltage of the discharge lamp; and a second capacitor for generating a second current based on a voltage output by said inverter circuit, wherein said constant voltage supply circuit sums the first current and the second current to generate said substantially constant voltage.

21. The ballast of claim 1, wherein said rectifier circuit is operated at a switching frequency of about that of said inverter circuit and different from a switching frequency of said input voltage to maintain a substantially constant input current.

22. The ballast of claim 1, wherein said phase dimmer compatible circuit further includes a plurality of capacitors connected at a common point, and wherein said keep-alive feedback circuit feeds back said energy to said common point.

23. The ballast of claim 22, wherein said rectifier circuit includes a plurality of diodes, and wherein said plurality of capacitors is at least three and further wherein each of said plurality of capacitors is connected to at least one of said plurality of diodes in said rectifier circuit.

24. The ballast of claim 23, wherein said common point is not directly connected to any of said plurality of diodes in said rectifier circuit.

25. The ballast of claim 8, wherein said constant voltage supply circuit provides said substantially constant voltage by obtaining energy from both said inverter circuit and the discharge lamp.

26. An electronic ballast for use with an external phase dimmer comprising:

a phase dimmer compatible circuit including a rectifier circuit adapted for rectifying a variable input current;

an inverter circuit coupled to the phase dimmer compatible circuit for converting the rectified current into high frequency alternating current to power a discharge lamp;

a feedback circuit for feeding back current from the discharge lamp to the phase dimmer compatible circuit in order that the phase dimmer compatible circuit can draw substantially continuous current from the external phase dimmer.

27. The ballast of claim 26 wherein the phase dimmer compatible circuit comprises a plurality of diodes configured in a full wave bridge configuration and operating at a frequency substantially the same as the inverter circuit.

28. The ballast of claim 27 wherein at any given time at least one diode is in a conducting mode.

29. The ballast of claim 27 wherein the phase dimmer compatible circuit further comprises a capacitor for reducing the crest factor of the discharge lamp.

30. The ballast of claim 26 further comprising:

a dimming control circuit for controlling the operation of the inverter circuit through a dimming range;

a constant voltage supply circuit for providing a substantially constant voltage to the dimming control circuit, said constant voltage relating to one or more of a voltage of said inverter circuit and said discharge lamp.

31. An electronic ballast for use with an external phase dimmer comprising:

a phase dimmer compatible circuit including a rectifier circuit adapted for rectifying a variable input current;

an inverter circuit coupled to the phase dimmer compatible circuit for converting the rectified current into high frequency alternating current to power a discharge lamp;

a dimming control circuit for controlling the operation of the inverter circuit through a dimming range;

a constant voltage supply circuit for providing a substantially constant voltage to the dimming control circuit, said constant voltage relating to one or more of a voltage of said inverter circuit and said discharge lamp.

32. The ballast of claim 31 further comprising a feedback circuit for feeding back current from the discharge lamp to the phase dimmer compatible circuit in order that the phase dimmer compatible circuit can draw substantially continuous current from the external phase dimmer.

* * * * *